US005724898A

United States Patent [19]

von Böckh et al.

[11] Patent Number: 5,724,898

[45] Date of Patent: Mar. 10, 1998

[54] GRATE FOR A FIRING SYSTEM

[75] Inventors: Peter von Böckh, Hölstein; Martin Zweifel, Haslen, both of Switzerland

[73] Assignee: Asea Brown Boveri AG, Baden, Switzerland

[21] Appl. No.: 688,775

[22] Filed: Jul. 31, 1996

[30] Foreign Application Priority Data

Aug. 2, 1995 [DE] Germany ..... 195 28 310.4

[51] Int. Cl.[6] ..... F23K 3/12

[52] U.S. Cl. ..... 110/291; 110/328

[58] Field of Search ..... 110/268, 270, 110/278, 285, 291, 298, 328, 329; 122/374, 375, 376; 432/77

[56] References Cited

U.S. PATENT DOCUMENTS

| | | | |
|---|---|---|---|
| 1,975,601 | 10/1934 | Graafen . | |
| 4,018,168 | 4/1977 | Andreoli et al. | 110/268 |
| 4,091,750 | 5/1978 | Thiesler et al. | 110/329 |
| 4,463,688 | 8/1984 | Andreoli | 110/278 |
| 4,876,972 | 10/1989 | Mrklas | 110/298 |
| 5,588,829 | 12/1996 | Stahl et al. | 110/291 |
| 5,636,581 | 6/1997 | Kleen et al. | 110/270 |

FOREIGN PATENT DOCUMENTS

| | | |
|---|---|---|
| 0 650 017 A1 | 4/1995 | European Pat. Off. . |
| 498538 | 5/1930 | Germany . |
| 1 232 305 | 1/1967 | Germany . |
| 94 16 320 U | 1/1995 | Germany . |
| 684118 A5 | 7/1994 | Switzerland . |

*Primary Examiner*—Henry A. Bennett
*Assistant Examiner*—Gregory A. Wilson
*Attorney, Agent, or Firm*—Oblon, Spivak, McClelland, Maier & Neustadt, P.C.

[57] ABSTRACT

The grate for a firing system has at least one rate conveyor having a plurality of fixed bar rows and moving bar rows alternating in the longitudinal direction, which are limited on both sides by side walls and which are composed of water-cooled grate plates (3; 4). These grate plates are provided with a multiplicity of orifices or slits (8), arranged in groups, for the supply of primary air and are each pivotably connected respectively to a fixed and a movable grate plate carrier (6) in the region of their rear end and rest with their front end on the adjacent grate plate. In order to cool optimally the grate plates (3; 4) subjected to high thermal stress, there are provided, on the underside of the grate plate, at least in some grate plates, cooling ducts (9) which are located between the orifices or slits (8), these cooling ducts being formed, on the one hand, by the grate plate itself and, on the other hand, by hollow profiles (10) attached to the grate plate.

20 Claims, 11 Drawing Sheets

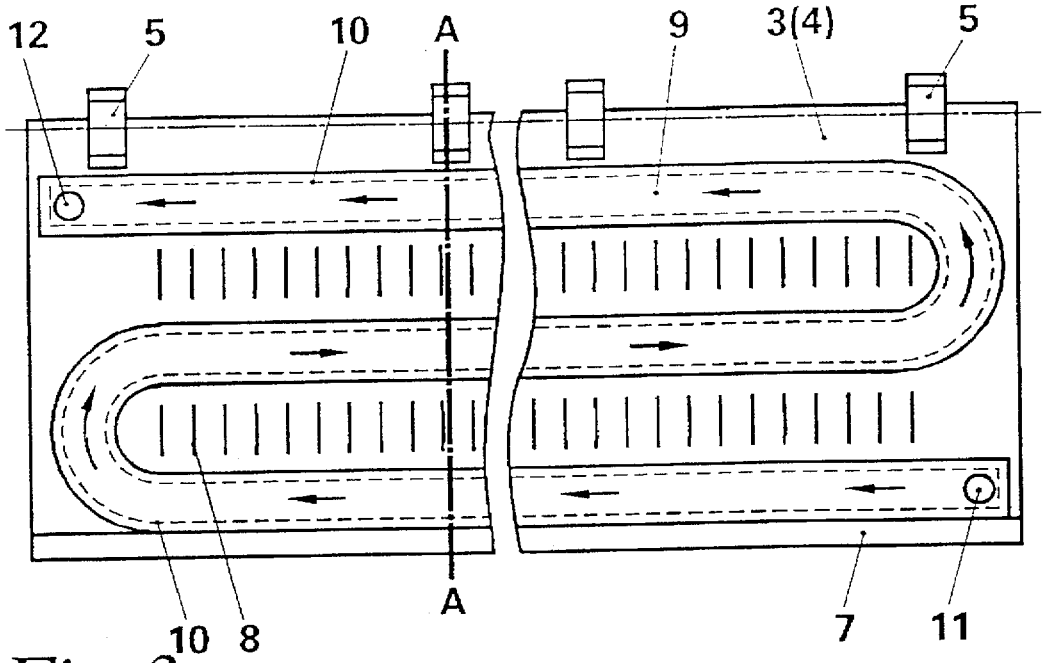
Fig. 3
Fig. 4 A-A
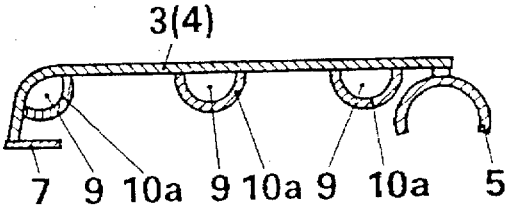
Fig. 5
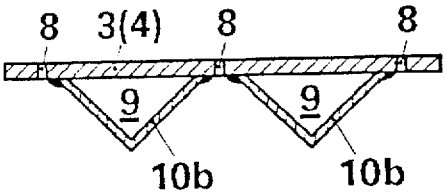
Fig. 6
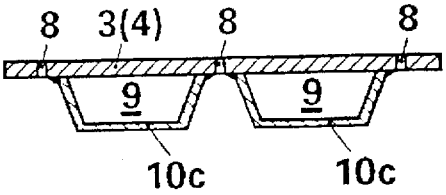
Fig. 7
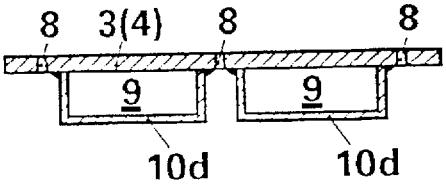

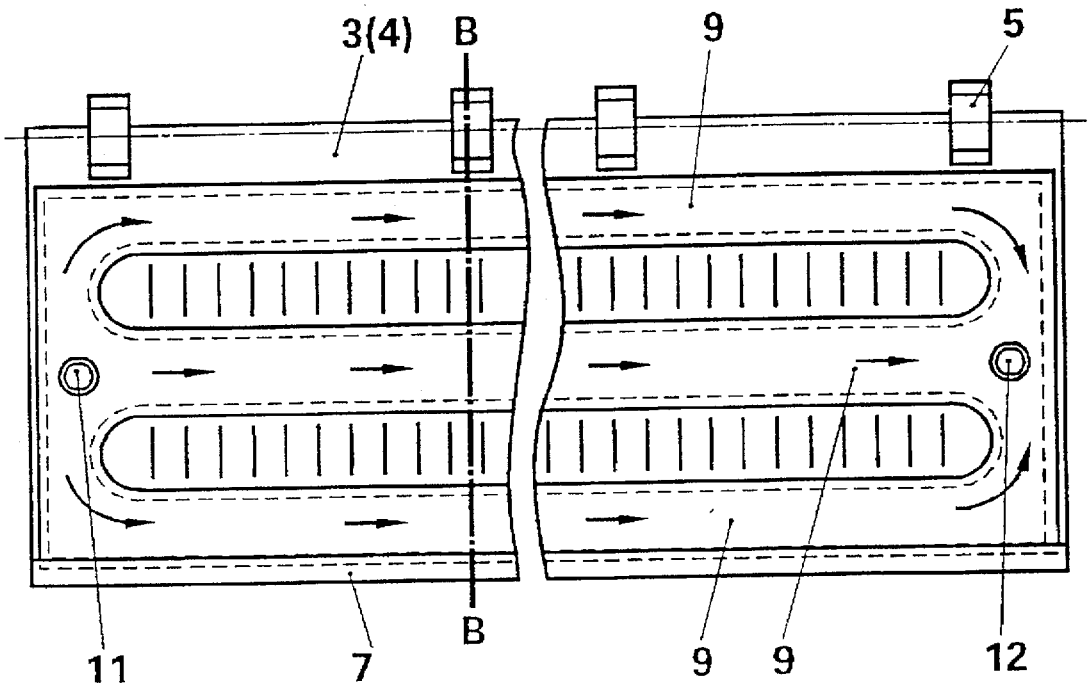
*Fig. 8*
*Fig. 9* B-B
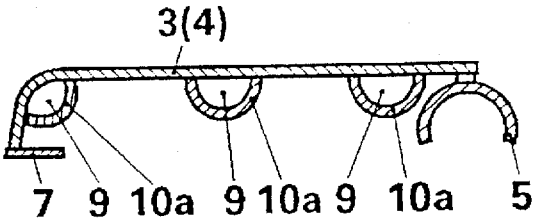

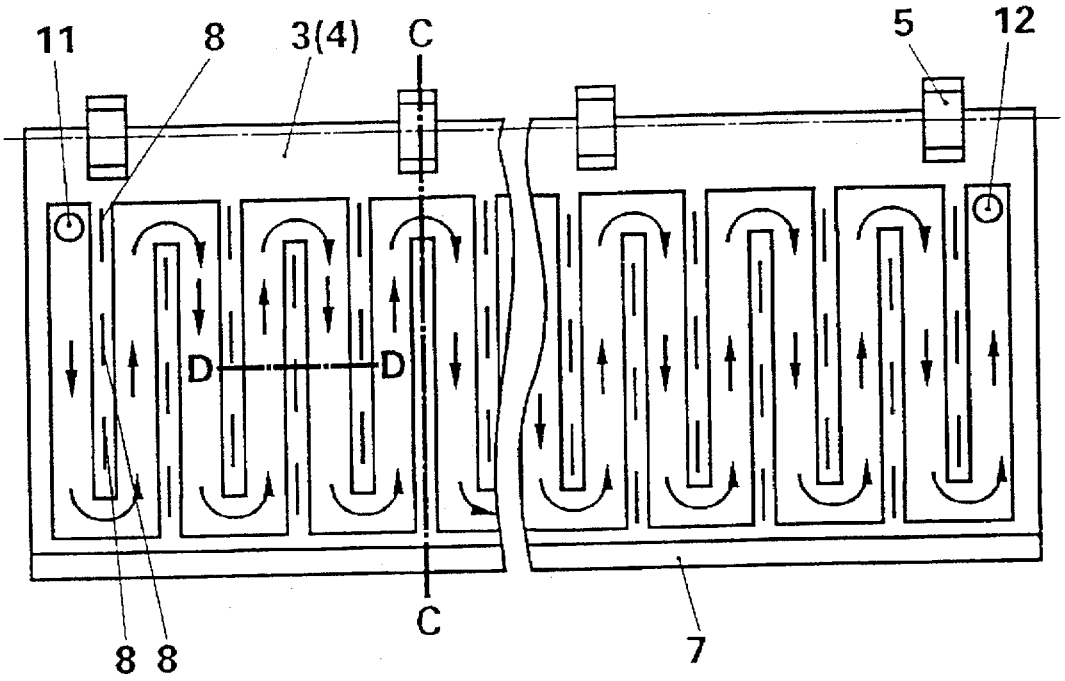
*Fig. 10*
*Fig. 11* C-C
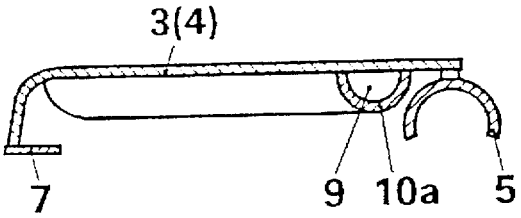
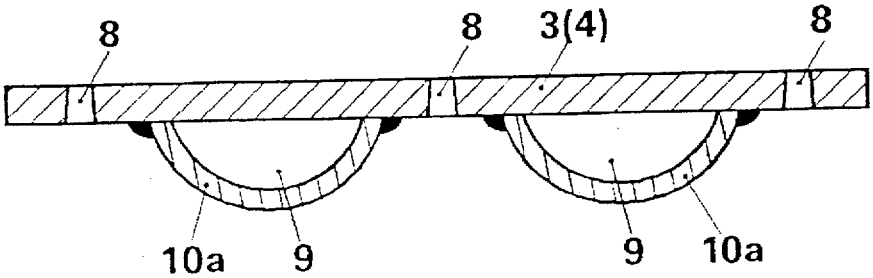
*Fig. 12* D-D

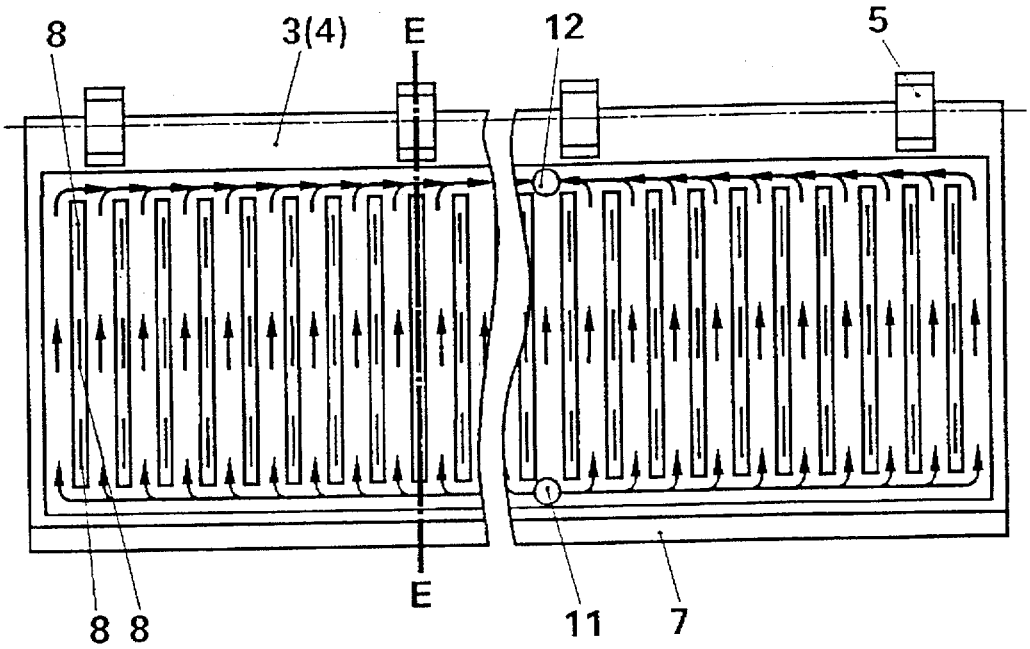
*Fig. 13*
*Fig. 14* E-E
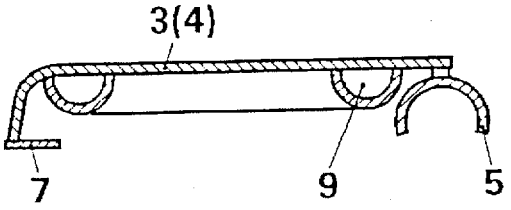

*Fig.16* G-G

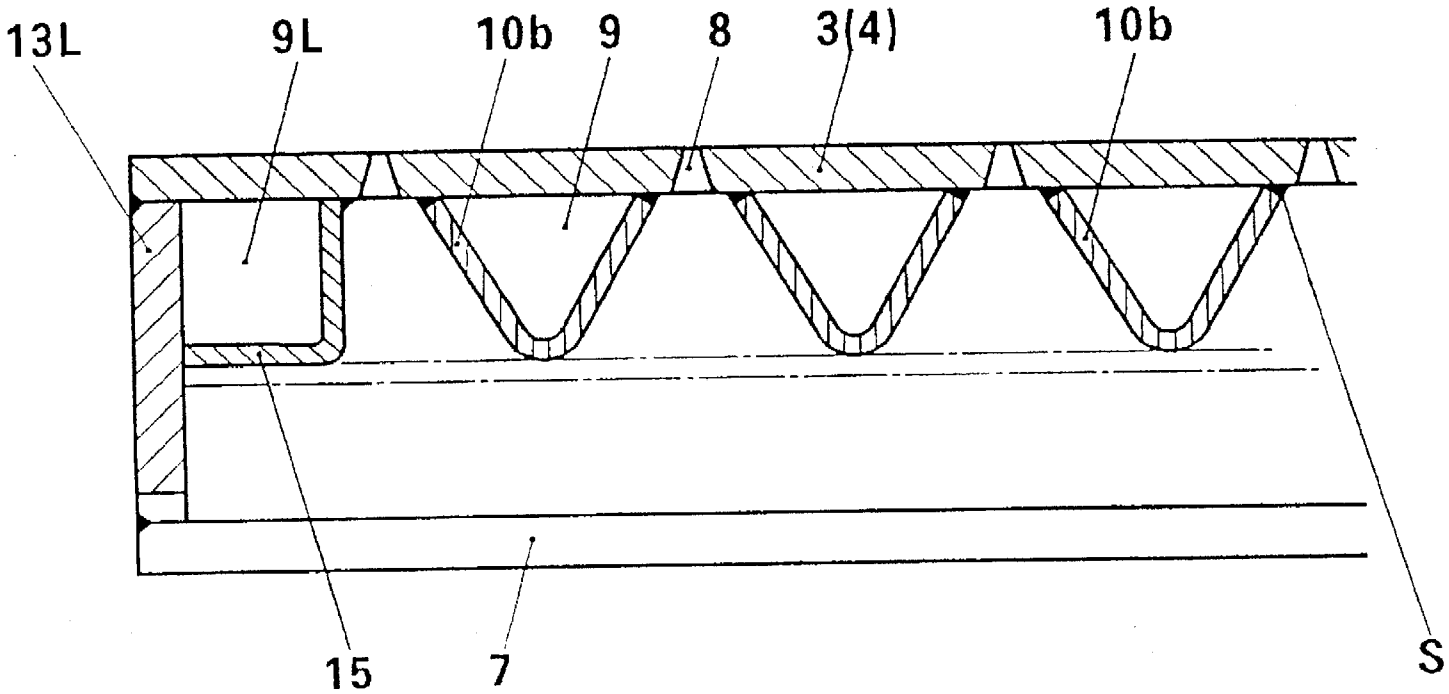
Fig. 19 I-I

GRATE FOR A FIRING SYSTEM

BACKGROUND OF THE INVENTION

1. Field of the Invention

The invention relates to a grate for a firing system, with at least one grate conveyor having a plurality of fixed bar rows and moving bar rows alternating in the longitudinal direction, which are limited on both sides by side walls and which are composed of liquid-cooled grate plates, said grate plates being provided with a multiplicity of orifices or slits, arranged in groups, for the supply of primary air and each being pivotably connected respectively to a fixed and a movable grate plate carrier in the region of their rear end and resting with their front end on the adjacent grate plate, the grate plates of a grate plate row being connected in each case by connection means arranged under these, in such a way that adjacent grate plates are displaceable relative to one another to a limited extent in the grate longitudinal direction and are pivotable to a limited extent with respect to the grate plate carrier assigned to them.

The invention at the same time refers to a prior art, such as emerges, for example, from CH Patent 684,118.

2. Discussion of Background

Grates of the generic type initially mentioned serve for incineration and simultaneous further transport of combustible material and are used primarily in garbage incineration plants.

In addition to air-cooled grate plates, in which the primary air supplied from below through slits in the grate plates serves at the same time as a cooling medium, water-cooled grate plates have been used for many years in order to increase the service life of the grate plates.

Thus, German Patent Application St 942 V/24f of 10.9.1995 proposes a stoking grate having alternately fixed and movable grate bar rows, in which the fixed grate bar rows are composed of cooling tubes which are arranged transversely to the grate direction and are inserted into the boiler water circuit and to which grate bars partially surrounding the tubes are fastened so as to bear flush on them.

The push-type incineration plate known from CH Patent 684,118 has a grate plate composed of an essentially rectangular hollow body made of sheet metal, said hollow body having, on one side of its underside, a junction connection piece and, on the other side of its underside, a discharge connection piece for the supply and discharge of a cooling fluid flowing through the hollow body. In this case, the supply of primary air takes place through a multiplicity of tubes having a round, elliptic or slit-shaped cross section, said tubes passing through the hollow body.

Whilst only a comparatively modest cooling effect can be achieved in the grate according to the German patent application, the grate according to CH Patent 684,118 is comparatively complicated to produce on account of the multiplicity of thin tubes for the guidance of primary air which have to be welded in sealingly.

SUMMARY OF THE INVENTION

Accordingly, one object of the invention proceeding from the prior art, is to provide a novel grate which is simple to produce and which can be optimally cooled.

This object is achieved, according to the invention, in that there are provided, on the underside of the grate plate, cooling ducts which are located between the orifices or slits, these cooling ducts being formed, on the one hand, by the grate plate itself and, on the other hand, by hollow profiles attached to the grate plate.

The advantage of the invention is to be seen, in particular, in that the cooling function and the supply of primary air are independent of one another. This means that, for example in contrast to the version according to CH Patent 684,118, the primary air does not have to be guided through the hollow body having a liquid throughflow, but only through the orifices or slits in the grate plate, so that heat exchange between the two media takes place only over the smallest possible distance, namely the thickness of the (solid) grate plate. However, the cooling effect is sufficient, because only comparatively narrow regions of the grate plate are not in direct contact with the cooling medium. There, however, cooling takes place by heat conduction. The production of the grate plate together with the cooling ducts can be carried out in an economically simple way, since only comparatively simple connections, preferably welded joints, have to be made, and moreover these are easy to check and, if appropriate, retouch.

Particularly in the embodiment of the invention considered especially advantageous at the present time, with cooling ducts through which the flow passes in the grate longitudinal direction, the distribution of the orifices or slits for the supply of primary air can be preserved virtually unchanged. This means, inter alia, that existing grate plates can be retrofitted with cooling ducts of this kind or, in the case of replacement acquisition, the outlay in terms of construction and manufacture is minimal and there is no need for any adaptation in the control/regulation of the supply of primary air.

A further essential advantage of the invention is that it is possible, without a high outlay, to make the arrangement of the cooling ducts such that fresh cooling water flows first through the front end of the grate plate, said front end being subjected to the most heat load. There is also the greatest possible freedom with regard to the position of the inlet and outlet connection pieces for the cooling medium, so that it is usually possible to arrange these in the region of the grate plate end.

Exemplary embodiments of the invention and the advantages achievable thereby are explained in more detail below by means of the drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein exemplary embodiments of the invention are represented diagrammatically. At the same time, identical or identically acting parts are provided with one and the same reference symbols in all the figures. In the drawings:

FIG. 3 shows a first exemplary embodiment of a grate plate having meander-shaped cooling ducts which extend transversely to the grate longitudinal direction and through which the low passes serially;

FIG. 4 shows a cross section through the grate plate according to FIG. 3 along its line AA with cooling ducts having a semicircular cross section;

FIG. 5 shows a modification of FIG. 4 with cooling ducts having a triangular cross section;

FIG. 6 shows a modification of FIG. 4 with cooling ducts having a trapezoidal cross section;

FIG. 7 shows a modification of FIG. 4 with cooling ducts having a rectangular cross section;

FIG. 8 shows a second exemplary embodiment of a liquid-cooled grate plate with cooling ducts which extend transversely to the grate longitudinal direction and through which the flow passes in parallel;

FIG. 9 shows a cross section through the grate plate according to FIG. 8 along its line BB with cooling ducts having a semicircular cross section;

FIG. 10 shows a third exemplary embodiment of a liquid-cooled grate plate with cooling ducts which extend in the grate longitudinal direction and through which the flow passes serially or in a meander-shaped manner;

FIG. 11 shows a cross section through the grate plate according to FIG. 10 along its line CC with cooling ducts having a semicircular cross section;

FIG. 12 shows a longitudinal section through the grate plate according to FIG. 10 and along its line DD on an enlarged scale;

FIG. 13 shows a fourth exemplary embodiment of a liquid-cooled grate plate with cooling ducts which extend in the grate longitudinal direction and through which the flow passes in parallel;

FIG. 14 shows a cross section through the grate plate according to FIG. 13 along its line EE with cooling ducts having a semicircular cross section;

FIG. 19 shows a cross section through the grate plate according to FIG. 17 along its line II.

DESCRIPTION OF TEE PREFERRED EMBODIMENTS

Figure 1:
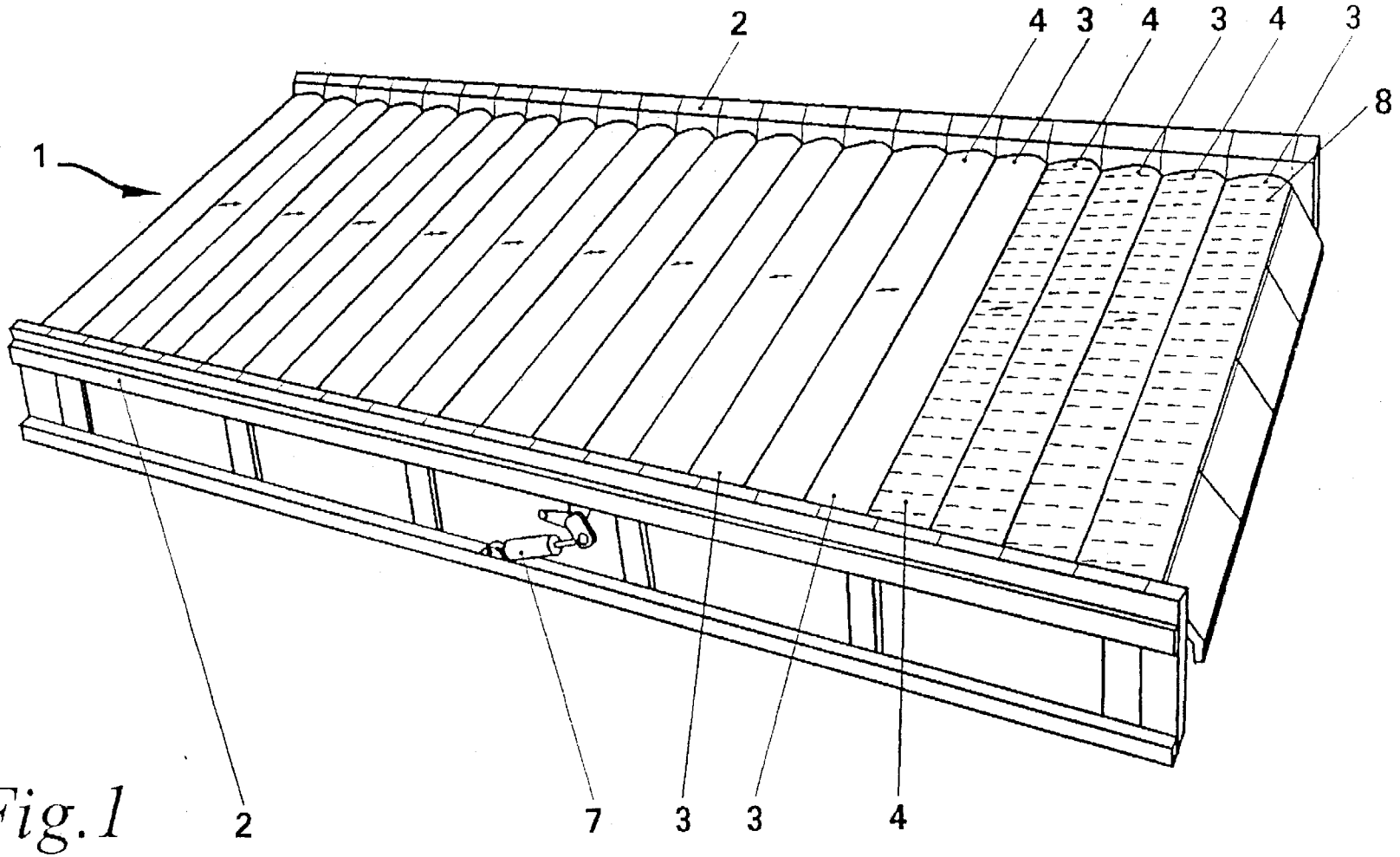
FIG. 1 shows a perspective representation of a conventional feed grate composed of moving bar rows and fixed bar rows comprising grate plates.
Figure 2:
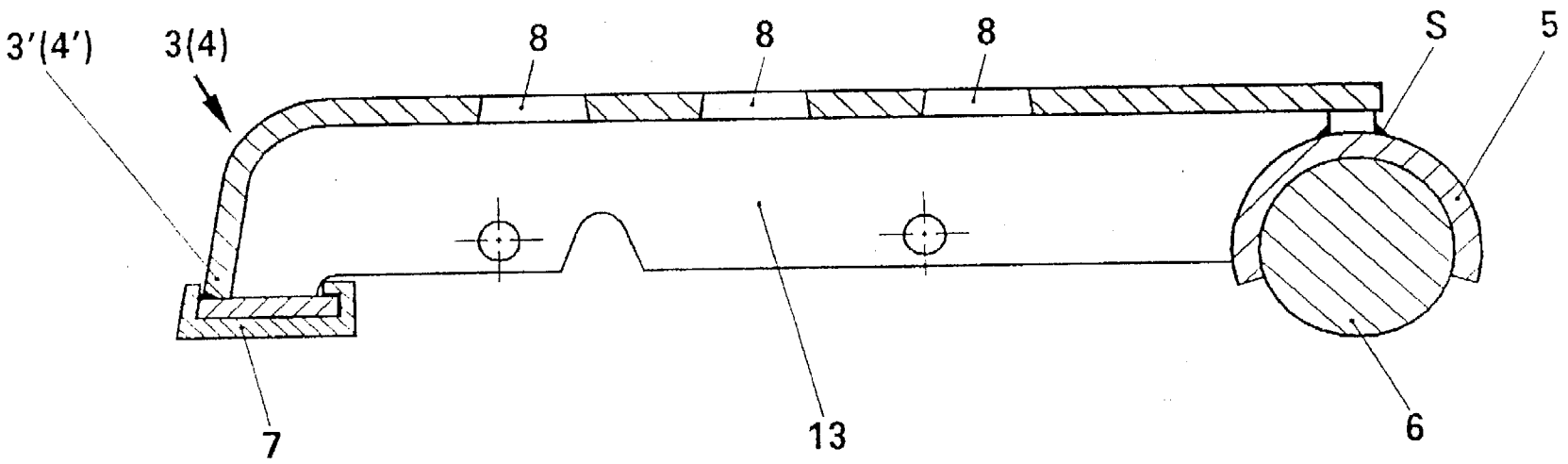
FIG. 2 shows a simplified cross section through a grate plate.

Referring now to the drawings, wherein like reference numerals designate identical or corresponding parts throughout the several views, in FIG. 1 the grate has a grate conveyor 1 which is limited on both sides by side walls 2. It can also have two or more grate conveyors arranged next to one another and separated by middle beams. The grate conveyor 1 is composed of fixed bar rows 3 and moving bar rows 4 alternating in the grate longitudinal direction and comprising grate plates. Fastened to the rear end of the grate plate is a half-open tubular piece 5, by means of which the grate plate rests on a grate plate carrier designed, here, as a rod 6 having a circular cross section (cf. FIG. 2). The grate plate carriers assigned to the fixed bar rows are connected fixedly to the side walls 2, and the grate plate carriers assigned to the moving bar rows are connected to one another and arranged displaceably in the grate longitudinal direction and can be moved to and fro relative to the fixed grate plate carriers by means of double-acting hydraulic or pneumatic cylinders arranged on both sides.

The grate plate itself is composed of a, for the most part, plane plate which is bent downward at the front end and terminates there in a sliding piece 7 extending approximately parallel to the plate. There, the grate plate rests on the grate plate which is nearest in the direction of movement of the combustible material. In the example, there are provided in the plane portion of the grate plate three rows of narrow slits 8 or orifices which widen downward both in the longitudinal and in the transverse direction and which extend parallel to the grate longitudinal direction. The primary air is supplied from the grate underside through these slits 8.

Thus far, grates of this type are known and are described in more detail and represented, for example, in EP 0,650,017 A1. For the sake of proper order, it may be noted, at the same time, that, in this known grate, each grate bar row is composed of a multiplicity of narrow grate bars, the primary air being guided through the gap between two adjacent grate bars.

As already stated initially, the grate bars (grate covering) are exposed to considerable thermal stresses. Because cooling by the primary air flowing through the grate from below is not sufficient alone to ensure a grate covering with a long service life, there is provision, according to the invention, for providing, on the underside of the grate plate, cooling ducts 9 which are located between the orifices or slits 8, these cooling ducts being formed, on the one hand, by the grate plate itself and, on the other hand, by hollow profiles 10 attached to the grate plate, as represented in simplified form in FIGS. 3 and 4. A cooling liquid, preferably water, is guided through these cooling ducts. The hollow profiles 10 are, for example, half-tubes 10*a* having a semicircular or oval cross section, which are welded onto the underside of the grate plate 3 (4) outside the slits 8. In addition to hollow profiles in the form of half-tubes 10*a* (FIG. 4), hollow profiles with a triangular cross section 10*b* (FIG. 5), hollow profiles with a trapezoidal cross section 10*c* (FIG. 6) or hollow profiles with a rectangular cross section 10*d* (FIG. 7) are employed. Of course, other cross-sectional forms, for example hollow profiles with an oval cross section, are also possible.

In the case of a arrangement according to FIG. 3 or 4, the throughflow takes place transversely to the grate longitudinal direction and serially or in a meander-shaped manner from the supply connection piece 11 on one narrow side of the grate plate to the discharge connection piece 12 on the opposite narrow side of the grate plate 3 (4).

In the version of a grate plate represented in FIGS. 8 and 9, with three cooling ducts 9 extending transversely to the grate longitudinal direction, the throughflow takes place in parallel, the cooling duct portions directly adjacent to the narrow sides of the grate plate 3 (4) functioning virtually as cooling water distribution chambers.

FIGS. 10 to 12 show an embodiment of the invention, in which the cooling ducts extend in the grate longitudinal direction and have the flow passing through them serially in a meander-shaped manner, a deflection of the flow taking place in each case at the start and end of the grate plate.

Following the version according to FIG. 8, a parallel throughflow can also be brought about in the case of cooling ducts extending in the grate longitudinal direction, as illustrated in FIGS. 13 and 14. Here, the cooling duct portions extending virtually over the entire grate plate width at the front and rear end of the grate plate 3 (4) form a kind of cooling water distribution chamber. In this case, the supply preferably takes place at the front end subjected to particularly high thermal stress.

Figure 15:
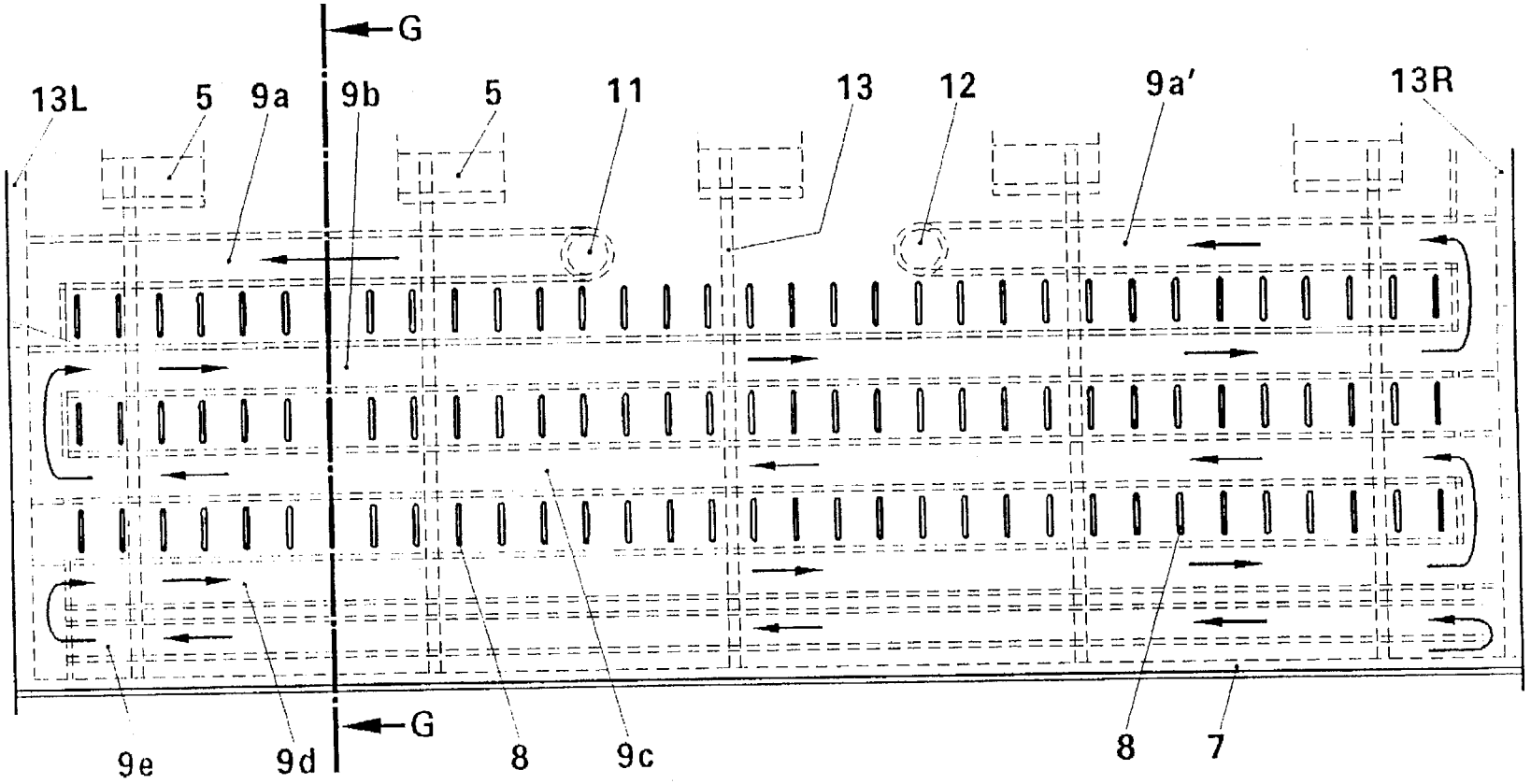
FIG. 15 shows a more detailed top view, corresponding to the embodiment according to FIG. 3, of the top side of a grate plate with cooling ducts through which the flow passes serially.
Figure 16:
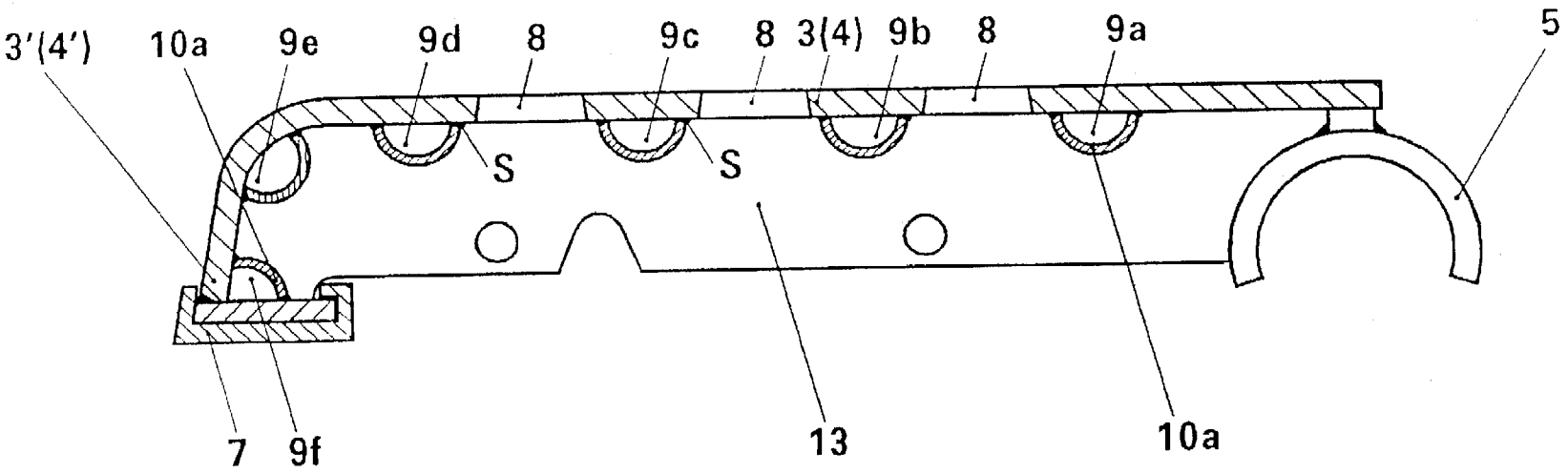
FIG. 16 shows a cross section through the grate plate according to FIG. 15 along its line GG.
Figure 17:
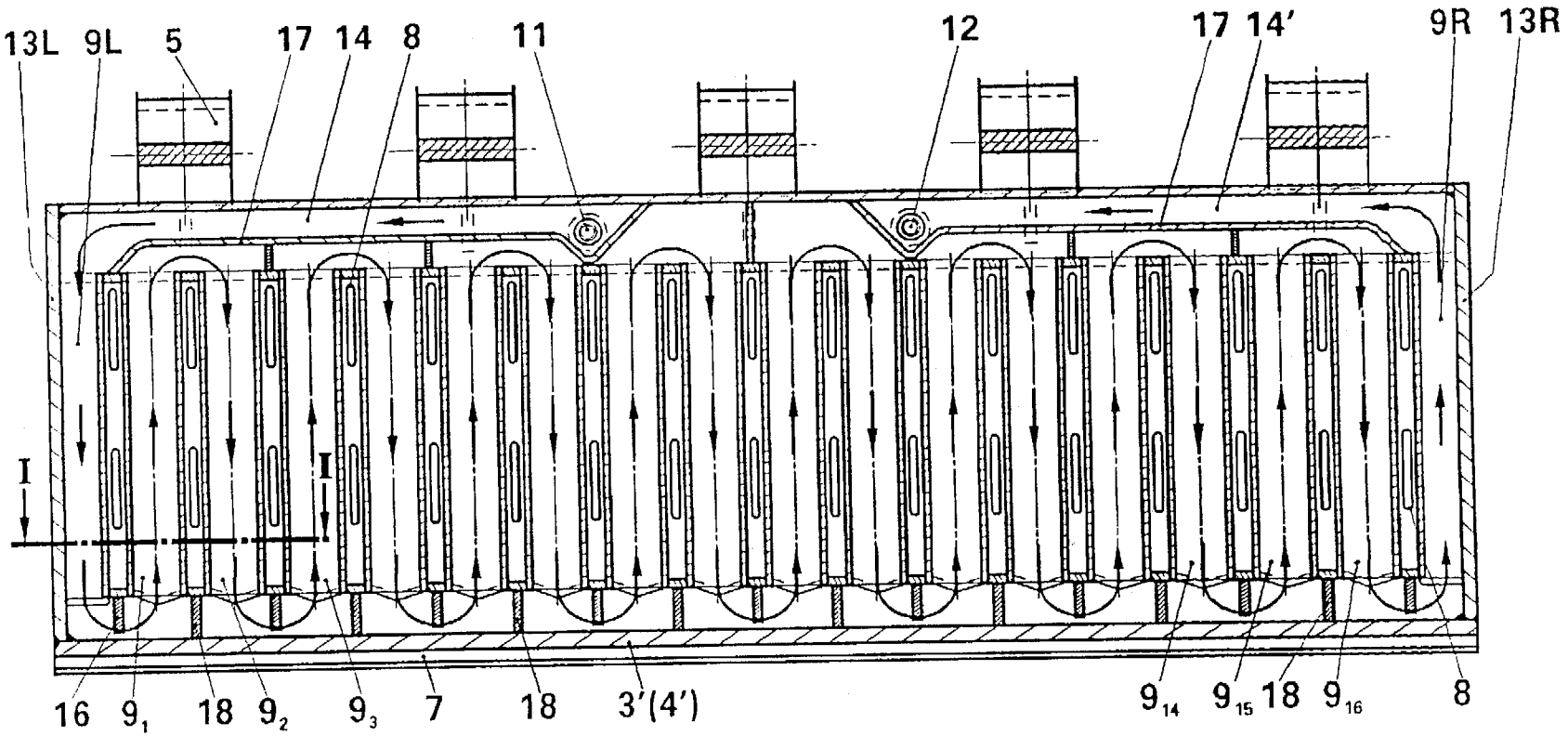
FIG. 17 shows a more detailed longitudinal section, corresponding to the embodiment according to FIG. 8, through a grate plate with cooling ducts which extend transversely to the grate longitudinal direction and through which the flow passes serially, along the line HH in FIG. 18.
Figure 18:
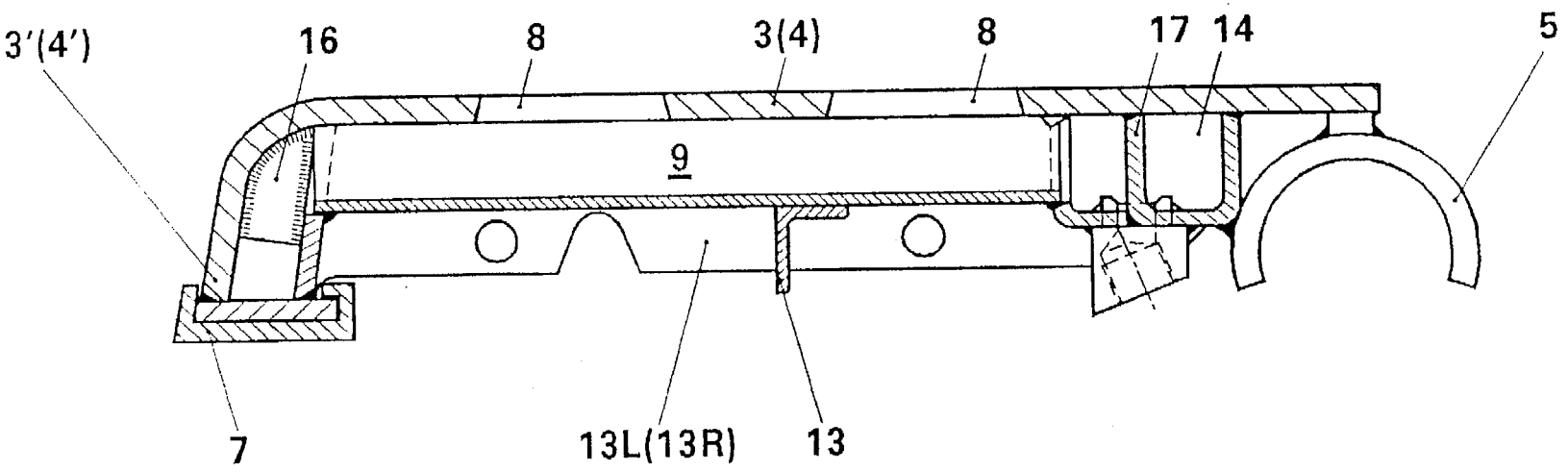
FIG. 18 shows a cross section through the grate plate according to FIG. 17.

FIGS. 15 and 16 as well as FIGS. 17 to 19 comprise representations of grate plates which are more detailed than the design versions of the invention hitherto presented, the embodiment represented in FIGS. 15, 16 corresponding, in principle, to the version according to FIG. 4 and that represented in FIGS. 17, 18 corresponding, in principle, to the version according to FIG. 10.

The grate plate 3 (4) is reinforced by webs or ribs 13 extending in the grate longitudinal direction; the webs on the plate narrow sides are designated by 13L and 13R. Analogously to FIG. 4, half-tubes 10*a* are fastened, preferably welded, in a liquid-tight manner on the underside of the grate plate 3 (4). These extend transversely to the grate longitudinal direction between the three slit groups. As emerges from the cross section according to FIG. 16, the slits 8 reach so far up to the half-tubes 10*a* as to leave sufficient space for making weld seams S. The supply and discharge of the cooling water take place at the rear end of the grate plate 3 (4) by means of supply connection pieces 11 and discharge connection pieces 12 in the middle portion of the grate plate 3 (4). A first cooling duct 9*a* leads from the connection piece 11 to the narrow side of the grate plate 3 (4), then emerges downward out of the plate plane and then extends, at the free end of the web 13L, as far as the front end of the grate plate 3 (4) and then opens into the cooling duct 9*f*. The latter is limited by a quarter tube 10*a*, the downward-pointing end 3' (4') of the grate plate 3 (4) and the sliding piece 7. The cooling duct 9*f* extends over the entire width of the grate plate 3 (4). After being deflected on the other plate narrow side, the cooling water flows through the cooling duct 9*e* in the rounding of the grate plate (FIG. 16), is deflected again at the plate end, then flows in sequence through the cooling ducts 9*d*, 9*c*, 9*b* and 9*a'* and leaves the grate plate through the discharge connection piece 12.

The described arrangement of the cooling ducts 9*a*, . . . through which the flow passes serially ensures that the front end of the grate plate, said front end being subjected to the most thermal stress, is loaded by fresh cooling water, whilst the rear end is cooled somewhat less intensely, although this is acceptable. As a result of the stoking movements (relative movements between the movable 4 and fixed 3 grate plates), the rear portion of the grate plate 3 (4) is, on average, exposed to the combustible material on the grate to a lesser extent than its front end. It could, at most, be considered a disadvantage that the length of the slits 8 is not freely selectable, because space for making the cooling ducts 9*a*, . . . must remain between adjacent slit groups. It may therefore be necessary to increase the number of slits 8 per slit group.

An especially preferred embodiment of the invention is represented in FIGS. 17 to 19. It corresponds, in principle, to the version represented in FIG. 10, that is to say has cooling ducts $9_i$ (i=1, . . . 16) extending in the grate longitudinal direction and having a triangular cross section. These are bent from sheet steel with a vertex angle of approximately 60 degrees and extend between the slits 8 and parallel to these. The supply of cooling water takes place in the middle portion of the grate plate 3 (4). A first transverse duct 14 leads from there on to the narrow side of the grate plate. Said transverse duct continues in a lateral cooling duct 9L at the left-hand plate edge and is formed by a rectangularly bent metal sheet 15 (FIG. 19). At the front plate edge, the cooling water experiences a deflection through 180 degrees and flows through the first triangular duct $9_1$ towards the rear grate plate end. So that the entire front part 3' (4') of the grate plate 3 (4) is swept by the cooling water, there is provided in the extension of the slits 8 a deflecting plate 16 which forces the flow downward. The renewed deflection at the rear grate plate end takes place by means of a partition 17 which extends transversely to the grate longitudinal direction and which at the same time limits the transverse duct 14. The cooling water thereafter flows through the next cooling duct $9_2$ and, once again, is deflected at the front end of the grate plate. A partition 18 extending in the grate longitudinal direction separates the cooling ducts $9_1$ and $9_2$. On the other narrow side of the grate plate, the cooling water is guided through a second lateral cooling duct 9R to the rear end of the grate plate, flows through a second transverse duct 14' and leaves the grate plate through the discharge connection piece 12.

As a look at FIG. 17 makes clear, this preferred embodiment of the invention affords in comparison with the version according to FIGS. 14 and 15, at comparatively little extra outlay, the advantage that virtually the entire area of the grate plate is in direct contact with the cooling water. Only the narrow strips between adjacent cooling ducts $9_i$ (i=1, . . . 16), where the slits 8 are located, are not directly cooled. Instead, there is sufficient space there (in the grate longitudinal direction) to accommodate the slits 8 necessary for the supply of primary air. At the same time, the front side of the grate plate, said front side being subjected to high thermal stress, is also cooled optimally, because there are virtually no dead water zones and, as a result of the deflection by the deflecting plates 16 in conjunction with the 180-degree deflection occurring there, turbulences which assist the heat exchange are generated.

Following CH Patent 684,118, the invention also offers the possibility of utilizing the cooling liquid for controlling the temperature of the grate or individual grate portions, in that, depending on the firing demand, individual or a plurality of adjacent grate plates are loaded with "preheated" cooling medium, so that the necessary grate plate temperature can be set in this way.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A grate for a firing system, with at least one grate conveyor having a plurality of fixed bar rows and moving bar rows alternating in the longitudinal direction, which are limited on both sides by side walls and which are composed of liquid-cooled grate plates, said grate plates being provided with a multiplicity of orifices or slits, arranged in groups, for the supply of primary air and each being pivotably connected respectively to a fixed and a movable grate plate carrier in the region of their rear end and resting with their front end on the adjacent grate plate, the grate plates of a grate plate row being connected in each case by connection means arranged underneath these, in such a way that adjacent grate plates are displaceable relative to one another to a limited extent in the grate longitudinal direction and are pivotable to a limited extent with respect to the grate plate carrier assigned to them, wherein there are provided, on the underside of the grate plate, cooling ducts which are located between the orifices or slits, these cooling ducts being formed, on the one hand, by the grate plate itself and, on the other hand, by hollow profiles attached to the grate plate.

2. The grate as claimed in claim 1, wherein the cooling ducts extend essentially parallel to the grate longitudinal direction.

3. The grate as claimed in claim 2, wherein the cooling water can flow through the cooling ducts serially, or in a meander-shaped manner, or in parallel.

4. The grate as claimed in claim 1, wherein the cooling ducts extend essentially transversely to the grate longitudinal direction.

5. The grate as claimed in claim 4, wherein the cooling water can flow through the cooling ducts serially, or in a meander-shaped manner, or in parallel.

6. The grate as claimed in claim 2, wherein the cooling ducts each extend between two adjacent slit groups in each case.

7. The grate as claimed in claim 4, wherein the cooling ducts each extend between two adjacent slit groups in each case.

8. The grate as claimed in one of claim 2, wherein, in the case of a parallel throughflow, cooling water distribution and cooling water collecting chambers are provided.

9. The grate as claimed claim 1, wherein the arrangement of the cooling ducts is made such that cooling water flows in a controlled manner first through the front end of the grate plate.

10. The grate as claimed in claim 3, wherein the cooling ducts each extend between two adjacent slit groups (8) in each case.

11. The grate as claimed in claim 5, wherein the cooling ducts (9) each extend between two adjacent slit groups in each case.

12. The grate as claimed in claim 3, wherein, in the case of a parallel throughflow, cooling water distribution and cooling water collecting chambers are provided.

13. The grate as claimed in claim 4, wherein, in the case of a parallel throughflow, cooling water distribution and cooling water collecting chambers are provided.

14. The grate as claimed in claim 5, wherein, in the case of a parallel throughflow, cooling water distribution and cooling water collecting chambers are provided.

15. The grate as claimed in claim 6, wherein, in the case of a parallel throughflow, cooling water distribution and cooling water collecting chambers are provided.

16. The grate as claimed in claim 7, wherein, in the case of a parallel throughflow, cooling water distribution and cooling water collecting chambers are provided.

17. The grate as claimed in claim 2, wherein the arrangement of the cooling ducts is made such that cooling water flows in a controlled manner first through the front end of the grate plate.

18. The grate as claimed in claim 3, wherein the arrangement of the cooling ducts is made such that cooling water flows in a controlled manner first through the front end of the grate plate.

19. The grate as claimed in claim 4, wherein the arrangement of the cooling ducts is made such that cooling water flows in a controlled manner first through the front end of the grate plate.

20. The grate as claimed in claim 5, wherein the arrangement of the cooling ducts is made such that cooling water flows in a controlled manner first through the front end of the grate plate.

* * * * *